United States Patent [19]

Martin et al.

[11] 4,355,491

[45] Oct. 26, 1982

[54] ROOF CONSTRUCTION AND METHOD

[75] Inventors: Otis M. Martin, 5624 Bodie Ct., San Jose, Calif. 95123; John K. Kough, Morgan Hill, Calif.

[73] Assignee: Otis M. Martin, San Jose, Calif.

[21] Appl. No.: 178,727

[22] Filed: Aug. 18, 1980

[51] Int. Cl.[3] ..... E04D 1/36; E04D 3/362

[52] U.S. Cl. ..... 52/540; 52/469; 52/544; 52/748

[58] Field of Search ..... 52/530, 540, 543, 550, 52/544, 469, 552, 551, 553, 748

[56] References Cited

U.S. PATENT DOCUMENTS

| | | | |
|---|---|---|---|
| Re. 27,502 | 10/1972 | Martin | 52/94 |
| 1,661,562 | 3/1928 | Conway | 52/544 |
| 2,062,149 | 11/1936 | Stark et al. | 52/544 |
| 2,672,831 | 3/1954 | Fink et al. | 52/543 |
| 3,626,651 | 12/1971 | Kough et al. | 52/536 |
| 3,664,081 | 5/1972 | Martin et al. | 52/540 |
| 3,696,570 | 10/1972 | Kough et al. | 52/105 |
| 3,731,438 | 5/1973 | Kough et al. | 52/540 |
| 3,760,856 | 9/1973 | Kough et al. | 52/94 |
| 3,785,114 | 1/1974 | Kough et al. | 52/748 |
| 3,841,050 | 10/1974 | Martin | 52/745 |
| 3,844,082 | 10/1974 | Martin et al. | 52/540 |
| 3,919,822 | 11/1975 | Martin et al. | 52/540 |

*Primary Examiner*—J. Karl Bell

*Attorney, Agent, or Firm*—Jack M. Wiseman; Francis W. Anderson

[57] ABSTRACT

Building roofing of the composition type. Members are combined with composition roofing material to provide the effect of shadow lines which enhance the appearance and aid the attachment of the composition to the underlying roof structure.

15 Claims, 24 Drawing Figures

ROOF CONSTRUCTION AND METHOD

BACKGROUND OF THE INVENTION

This invention relates generally to the construction of composition roofing for buildings, and to a method for applying the same to conventional roof structures.

The term "composition roofing" as used herein has reference to material of uniform width (e.g., 36 inches) generally marketed in rolls. It commonly consists of suitable fibrous material such as cellulosic fiber, fiberglass, asbestos fiber or comparable materials impregnated with asphalt or other waterproof and protective materials. The upper exposed surface is often coated with mineral aggregate (e.g., sized mineral chips or gravel). In constructing a roof using such composition, the strips making up the rolls are laid horizontally on the roof structure in parallel horizontal courses, with the lower margin of one course overlapping the upper margin of the next lower course. The composition is attached to the roofing structure as by nails, adhesive and/or mastic. A common procedure is to apply some adhesive or mastic to the overlapping margins of the strips after applying nails or tacks through the top portions. Such a roof has the advantages of simplicity and low cost. However, it has a number of disadvantages, including an unattractive appearance, and, frequently, insufficient anchoring of the composition to the underlying structure. Thus, wind conditions may cause movement of the composition with stressing and possible breakage of the composition at points of attachment to the structure. Also, elevated temperatures during the summer months cause softening of the impregnating asphalt, and this together with the weight of the composition tends to cause sagging, which likewise places stresses on the points of anchorage to the structure. In addition, exposed edges of the composition along the junctions between the courses, which are not surfaced with mineral, tend to deteriorate more rapidly than other areas, with weakening of the composition and possible development of leakage. All of the disadvantages thus mentioned tend to limit the useful life of composition roofs, and may necessitate repairs or replacements long before the major part of the composition has seriously deteriorated.

SUMMARY OF THE INVENTION AND OBJECTS

In general, it is an object of the present invention to provide a roofing construction having the desirable features of conventional composition roofs, namely simplicity and low cost, without the previously mentioned disadvantages. Particularly, composition roofs made according to the present invention are characterized by attractive appearance and by adequate anchoring of the composition to the underlying roof structure.

Another object is to provide a composition roofing in which no unprotected horizontal edges of the composition strips are left exposed to the weather.

Another object is to provide a composition roofing having the optical effect of shadow lines which break up the surface of the roof according to a predetermined pattern.

Another object is to provide a novel, simple and inexpensive means and method for producing the optical effect of shadow lines on an otherwise plain composition roofing surface.

Another object is to provide a novel method of producing roofing using conventional roofing composition as the base material, with the finished construction providing a predetermined design by virtue of shadow line effects.

In general, the present invention is applicable to conventional sloped roof structures. The roof construction consists of strips of roofing composition applied to the structure in horizontally extending courses, with the lower edge margin of each strip overlapping and joined with the upper edge margin of the next lower strip. Means are applied to the composition which provide horizontal shadow line forming surfaces. These shadow line forming surfaces are faced downwardly with respect to the slope of the roof, and extend upwardly from the plane of the roofing composition. In one embodiment, the horizontal shadow forming surfaces are provided by strips applied to the composition, which are triangular in section. Also, in a preferred embodiment, additional shadow forming means is provided which extend at right angles to the horizontal strips, and which break up the areas between the horizontal strips by shadow forming lines extending parallel to the slope of the roof. Also, the invention provides a method of assembly and constructing such a roof construction.

DESCRIPTION OF THE PREFERRED EMBODIMENTS

Figure 1:
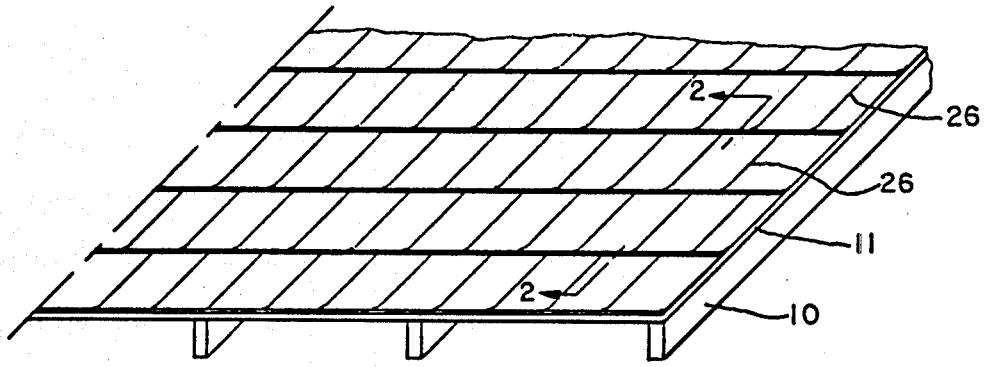
FIG. 1 is a perspective view illustrating a roofing construction in accordance with the present invention.
Figure 2:
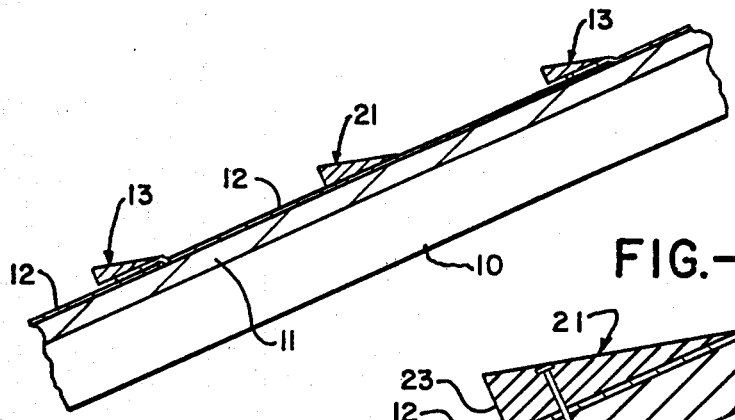
FIG. 2 is an enlarged cross-sectional detail taken along the lines 2—2 of FIG. 1.
Figure 3:
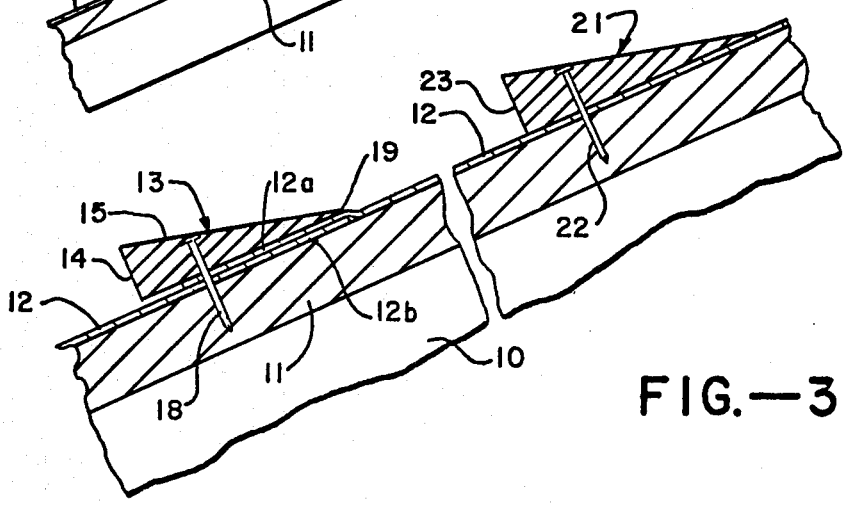
FIG. 3 is a detail showing a shadow forming strip applied over overlapping portions of composition strip on a scale greater than that of FIG. 2.

Referring to FIGS. 1–3, the roof construction illustrated is applied to the roof structure of a building consisting of structural rafters 10 and the sheathing 11. The sheathing may for example be sheets of plywood, or may be sheathing boards. The construction which is applied upon the sheathing 11 consists of strips 12 of suitable composition, such as cellulose fiber impregnated with asphalt. As previously mentioned, this type of composition is marketed in strips that are commonly 36 inches in width. As is customary in present-day composition roof practice, the lower edge margin of one horizontal course or strip of composition is overlapped with respect to the upper edge margin of the next lower course. Such an overlap is shown in FIG. 3 where the margin 12*a* of one course is in overlapping relation with the underlying upper margin 12*b* of the next lower course. A mastic or cement is generally applied between the overlapping margins.

According to the present invention, shadow forming strips 13 are applied over the composition. These strips extend horizontally, and at least some of these strips are disposed over the junction between the margins 12*a* and 12*b*. A suitable construction for such strips is shown in FIG. 3. In this instance the configuration in section of these strips is triangular, with the bottom surface of the triangle being seated upon the composition, and with the edge face 14 being faced downwardly with respect to the slope of the roof. The upper exposed surface 15 extends from the edge face 14 to the apex edge 19. This apex edge merges with the upper surface of the composition in the manner illustrated in FIGS. 2 and 3. As shown in FIG. 3, the bottom surface of each strip is flat. The strip applied over the junction preferably extends below the horizontal edge of the top composition margin, thereby protecting the same from direct exposure to the suns rays.

Figure 4:
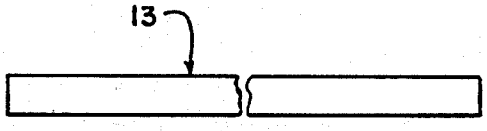
FIG. 4 is an edge view of a shadow forming strip such as is incorporated in the construction of FIGS. 1–3.
Figure 5:
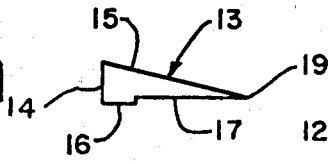
FIG. 5 is an end view of the strip shown in FIG. 4.

In the construction shown in FIGS. 4 and 5, the bottom surface of the strip 13 is provided with a toe 16 which is offset from the bottom surface 17, thereby providing recessing which is dimensioned to accommodate the upper portion 12 of the overlap between the composition strips. The toe serves to cover and protect the lower edge of the corresponding composition strip, which is not covered with mineral, from direct exposure to the elements.

Figure 6:
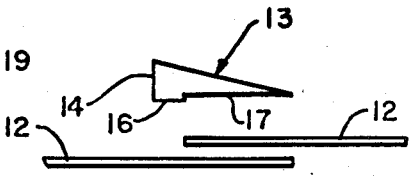
FIG. 6 is an exploded view illustrating the manner in which a horizontal shadow forming strip is applied over overlapping edge margins of the composition strips.

In FIG. 3, nails 18 are shown driven through the horizontal strips 13 and through the overlapping portions of the composition into the sheathing 11. This method of attachment not only secures the strips in place, but in addition firmly anchors the overlapping margins of the composition strips to the roof sheathing. Exploded FIG. 6 shows more clearly the manner in which horizontal strips 13, provided with toes 16, overlie the overlapping portions of the composition strips, with the inner edge of the toe 16 serving to protect the lower edge of the upper margin 12*a*.

While a composition roof can be constructed utilizing horizontal shadow forming strips overlying only the areas where the strips have overlapping margins, it may be desirable for aesthetic appearance and to provide additional attachment of the composition to the sheathing, to employ one or two additional horizontal strips between the strips overlying the overlap areas. In FIGS. 2 and 3, an intermediate strip 21 is shown extending between the strips 13, and may have the same general proportions and cross-section configuration as the strips 13. The strips 21 are likewise being shown secured to the composition and to the underlying sheathing by nails 22.

The horizontal shadow line forming strips 13 and 21 can be made of any suitable material, such as wood, molded plastic, rubber or various compositions. Preferably, either before or after the strips are applied to the roof, the upper surfaces are treated whereby their appearance blends with the upper surface of the composition or with the edge faces 14 of the strips. The edge faces 14 and 23 of the horizontal strips are dark in color, black being preferred. The top surfaces can be black or of a dark color or may be mineralized to blend with the composition.

Irrespective of the material from which the horizontal strips are made, they should be capable of withstanding weather conditions to such an extent that they will not deteriorate before general deterioration of the composition strips. In the event strips made of wood are employed, it is desirable that they be impregnated with suitable preservatives, such as creosote and the like to prevent rotting and other deterioration.

It is desirable, although not essential, to provide additional shadow line forming means extending in the direction of the slope of the roof (i.e., vertically) and between the horizontal strips. FIG. 1 shows shadow line forming means 26 extending between adjacent horizontal shadow line forming strips and which serve to break up the areas between horizontal shadow line formings strips into rows of smaller panel-like areas. In this instance the shadow line forming means 26 of one row is staggered with respect to the adjacent rows. Such shadow line forming means may consist of line forming material of dark color which is applied between the horizontal strips 13 and 21. By way of example, we have found it satisfactory to apply beads of black mastic to provide the pattern shown in FIG. 1. In place of mastic or like material, we have employed strips made of suitable material adhesively secured to the upper surface of the composition in the areas between the horizontal strips 13 and 21.

The horizontal shadow line forming strips 13 and 21 can be of any convenient length. Assuming that the strips are made in lengths which for example may vary from 4 to 10 feet, they are applied to the roof end-to-end to extend from one edge of the roof to the other.

Figure 7:
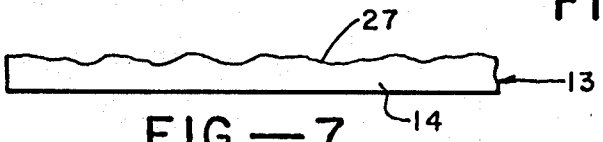
FIG. 7 is a view looking toward one edge of a horizontal shadow forming strip with the strip in this instance having an irregular configuration.
Figure 8:
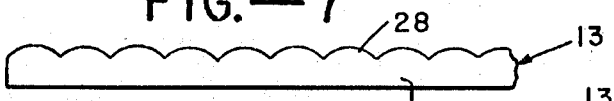
FIG. 8 is a view of a horizontal shadow forming strip in which it has another configuration to enhance the appearance of the roof structure.
Figure 9:
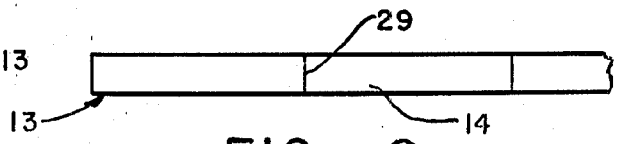
FIG. 9 is a view looking toward the edge face of a horizontal shadow forming strip with scarfing or markings which modify its appearance in the completed roof construction.

As illustrated in FIGS. 7, 8 and 9, instead of providing the horizontal shadow forming strips with smooth edges, the upper edge of the face 14 can be made irregular as shown in FIG. 7, thus imparting an irregular appearance to the shadow line. In FIG. 8 the irregularity is bead-like, and in FIG. 9 the area of the edge face 14 is broken into small areas by the vertical scarf lines 29. These scarf lines may be aligned with the corresponding vertical shadow line forming means 26.

Figure 10:
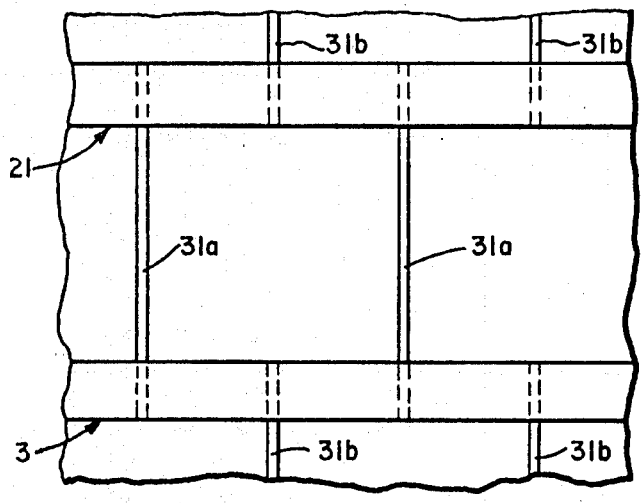
FIG. 10 is a plan view of a roof construction made according to the present invention illustrating one method of providing and attaching vertically extending shadow forming strips.

Assuming that strips of material are utilized to form the vertical shadow line forming means 26, various arrangements can be used as shown in FIGS. 10–19 inclusive. In FIG. 10 the shadow line forming strips 31 extend between the horizontal strips 13 and 21, and their end portions extend underneath the horizontal strips. Such strips may be made of suitable material such as plastic, synthetic rubber, elastomer, composition or the like. By way of example, such strips may, depending upon the appearance desired, vary in width from ½ to 2 inches and in thickness from ⅛ to ⅜ inches. The portions extending between the horizontal strips 13 and 21 can be adhesively secured to the upper surface of the composition as by use of mastic or other adhesive, or by nails or other fastening devices. Here again the strips should provide a dark color, preferably black.

Figure 11:
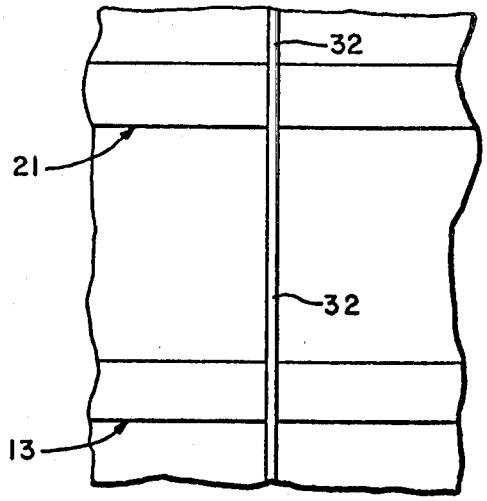
FIG. 11 is a plan view like FIG. 10, but showing another manner of providing the vertical strips.

In FIG. 11 the vertically aligned shadow line strips 32 have their upper ends extending beneath a horizontal strip, and lower end portions which extend over and are secured to the upper surface of the next lower horizontal strip.

Figure 12:
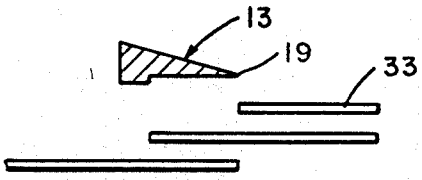
FIG. 12 is an exploded view in section illustrating application of the horizontal shadow forming strips to the overlapping portions of the composition sheet and also illustrating the additional vertically extending shadow forming means.
Figure 13:
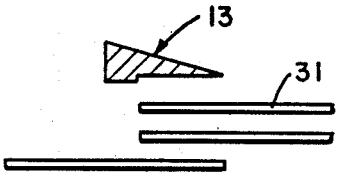
FIG. 13 is an exploded view like FIG. 12, but in this instance showing the vertical shadow forming means extending beneath the horizontal shadow forming strips.
Figure 14:
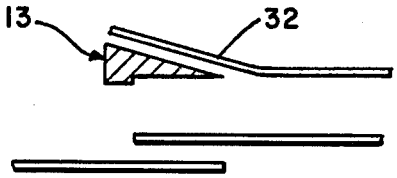
FIG. 14 is an exploded view similar to FIG. 12 but in this instance showing the vertically extending shadow forming means having a portion overlying the upper surface of the horizontal shadow forming strip.
Figure 15:
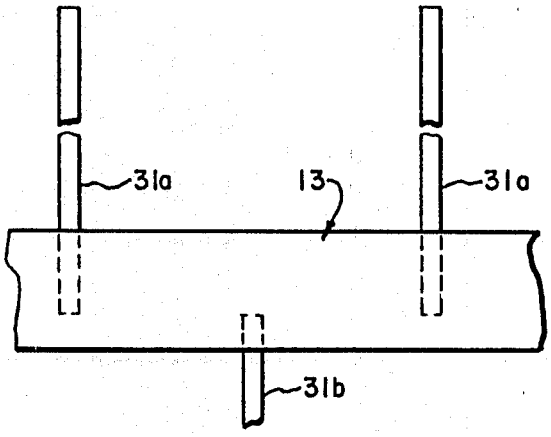
FIG. 15 is a plan view showing an assembly comprising a horizontal strip together with strips extending at right angles to the same for forming shadow lines.

Various possible arrangements for the vertically extending shadow line strips are shown in FIGS. 12, 13 and 14. FIG. 12 shows an arrangement in which the vertically extending strips 33 terminate at the apex edge 19 of the adjacent horizontal strip. FIG. 13 shows an arrangement in which strips 31 are arranged to underlie the adjacent horizontal strip substantially in the manner illustrated in FIG. 10. FIG. 14 shows the manner in which strips 32 may have their lower ends extending over and secured to the upper face of the adjacent horizontal strip in the manner illustrated in FIG. 11. The entire length of such strip as shown in FIG. 14 can be secured to the composition and the horizontal strips by suitable means, such as mastic, nails or other fastening devices.

Figure 16:
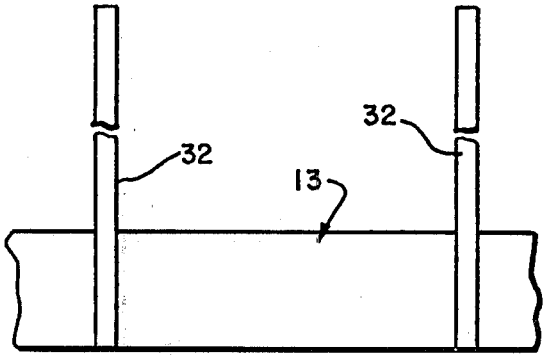
FIG. 16 is a plan view similar to FIG. 15 but showing a modified assembly of shadow forming strips.

In some instances it is desirable to provide factory made assemblies each including a horizontal shadow forming strip and strips of flexible or rigid material secured to the same which can be used to form the vertical shadow forming means. Thus the assembly shown in FIG. 15 can be used to form an assembly as shown in FIG. 10. In this instance the end portions of the strips 31 are secured to the underside of the strip 13. Such assemblies provide both horizontal and vertically extending shadow forming means, and in addition they permit factory assembly of certain parts, thereby facilitating the labor of applying the shadow forming means to the composition roofing. In the manufacture of such an assembly, strips 31 may be integral with strips 13 or attached to the same as by stapling or adhesive. Another assembly is shown in FIG. 16 in which the end portions of strips 32 are secured to the upper side of strip 13.

Figure 17:
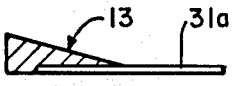
FIG. 17 shows one manner of attaching vertical shadow line forming strips to horizontal shadow forming strips as a preassembly.
Figure 18:
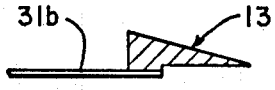
FIG. 18 is similar to FIG. 17 but shows the vertically extending shadow line forming strips secured to the underside of the base surface of a horizontal shadow forming strip.
Figure 19:
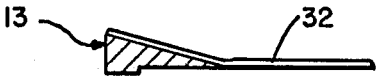
FIG. 19 is similar to FIG. 17 but showing the vertically extending shadow line forming strips applied over the upper surface of the horizontal strips.

FIGS. 17 and 18 show two methods of attachment of strips 31 to the underside of strip 13. FIG. 19 shows attachment of a strip 32 to the upper side of strip 13.

Figure 20:
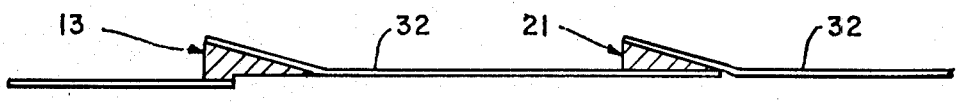
FIG. 20 is a schematic side elevation showing one arrangement of horizontal and vertical shadow line strips.

Assuming that the arrangement of FIG. 19 is employed, then the positioning of strips 32 with respect to two adjacent horizontal shadow line forming strips 13 and 21 can be as shown schematically in FIG. 20. In this instance each vertical extending strip 32 has one end portion overlying and secured to the upper side of the strip 13, and the strip 21 is applied over the upper end portion of the strip 32. Strip 21 likewise carries strips 32 having end portions secured to its upper surface. Thus assemblies having strips 13 and 21 may be applied successively to cover the entire roof area.

As previously mentioned, the dimensions of the horizontal shadow line forming strips shown in FIGS. 1–20 can be varied depending upon the type of roof to which they are applied and the degree to which the shadow line effect is desired. For example, the edge faces 14 of the horizontal strips may vary from ½ to 1 inch or up to 2 inches for industrial buildings. The width of the strips, that is, the width from the edge face 14 to the apex edge, may vary from 1 to 6 inches. The extension of each strip beyond the corresponding horizontal edge of the composition to which it is applied may be about ¼ to ½ inch. The vertical shadow line forming strips may, as previously explained, be markings or beads applied by suitable material such as black mastic, or they may be strips of material having a dark or preferably black color which can be secured as by means of adhesive to the composition. Such strips may vary in width from ½ to 2 inches, and in thickness from ⅛ to ⅜ inches.

Figure 21:
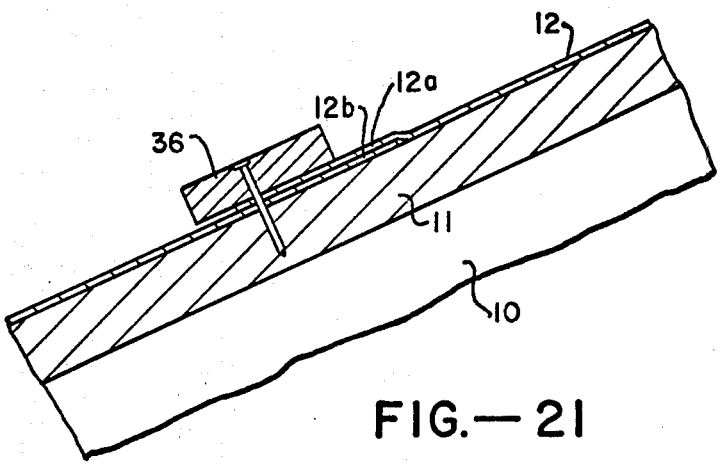
FIG. 21 is an enlarged detail in section showing a shadow line forming strip that is rectangular in section.
Figure 22:
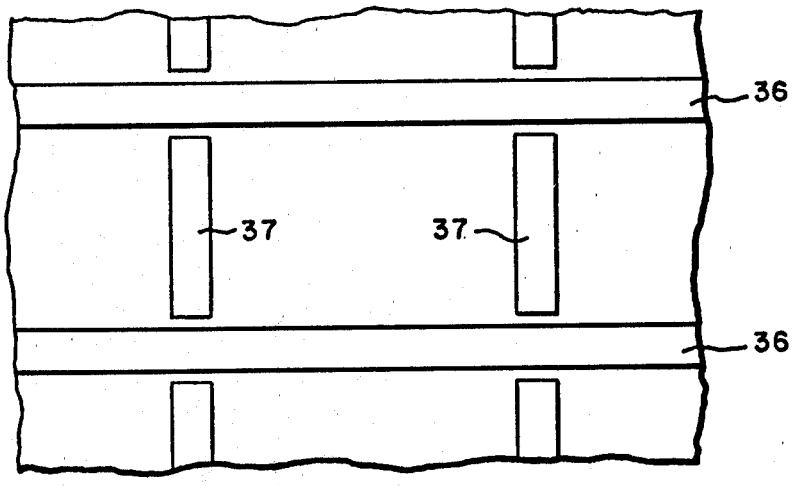
FIG. 22 is a plan view showing another arrangement of horizontal and vertical strips.
Figure 23:
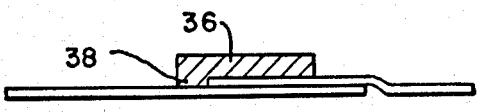
FIGS. 23 and 24 are enlarged details in section showing other possible configurations for shadow forming strips.
Figure 24:
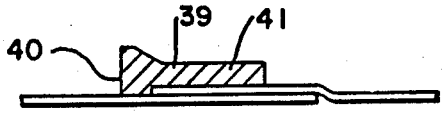

As indicated above, the shadow forming strips may not have a triangular configuration. Thus as shown in FIG. 21, the horizontal strips 36 are rectangular in section and applied over the overlapping margins **12*a* and 12*b*, with one edge extending beyond the exposed edge of margin 12*a* to protect the same from direct sunlight. In FIG. 22 such strips 36 are used with similar vertical strips 37, made either of rigid or flexible material, that are secured by suitable means. The dimensions of strips 36 and/or 37 may also be such that they are square in section. As shown in FIG. 23 strips 36 may be provided with a toe 38 corresponding to the toe 16 of FIG. 5. In FIG. 24 the strip 39 is thickened along one edge to form the end face 40, while the portion 41** of the strip is of lesser thickness.

In general, the present invention permits a variety of shadow line patterns on a composition type roof. The invention not only enhances the appearance of composition roofs, but in addition it performs the function of more securely attaching the composition courses to the underlying roof structure.

We claim:

1. In a roof construction applicable to an inclined roof structure, strips of roofing composition applied to the structure in courses extending generally horizontally along the structure with the lower edge margin of each strip being disposed in overlapping contact with the upper edge margin of the next lower strip, and elongate members providing shadow line forming surfaces extending in spaced parallel relation along the structure, each of said members being applied over one of the joints formed by the overlapping edge portions of the composition strips and over the lower edge of the uppermost strip at the joint.

2. In a roof construction as claimed in claim 1 in which said shadow line forming strips are rectangular in section.

3. In a roof construction as claimed in claim 1 in which the lower side of each of said elongate members is provided with an offset toe portion which defines a recessed area having a wall that is spaced from and is generally parallel to the shadow-line surface of the elongate member and a surface that overlies and is in face-to-face contact with the uppermost composition strip at the associated joint.

4. A roof construction according to claim 3 wherein the lower edge margin of the uppermost composition strips of the associated joint abuts the wall of the recess in said toe portion.

5. A roof construction according to claim 1 further comprising fastening means extending through each elongate member and through the two underlying edge margins of the composition strips at the associated joint for securing said member and said strips to the roof structure.

6. In a roof construction applicable to an inclined roof structure, strips of roofing composition applied to the structure in courses extending generally horizontally along the structure with the lower edge margin of each strip being disposed in overlapping contact with the upper edge margin of the next lower strip, elongate members providing shadow line forming surfaces extending in spaced relation along the structure generally parallel to said strips, and horizontally spaced shadow line forming means extending between said elongate members in a direction extending upwardly along the slope of the roof structure.

7. In a roof construction as claimed in claim 6 in which said last named shadow forming means are in the form of strips secured to the upper surface of the composition 8. A roof construction according to claim 6 wherein said upwardly-extending shadow-line forming means comprises a plurality of strips, each of which has one end portion underlying one of said elongate members.

9. A roof construction according to claim 6 wherein said upwardly-extending shadow-line forming means comprises a plurality of strips, each of which has both end portions underlying one of said elongate members.

10. A roof construction according to claim 6 wherein said upwardly-extending shadow-line forming means comprises a plurality of strips, each of which has a lower end abutting one of said elongate members and an upper end underlying the elongate member next above.

11. A roof construction according to claim 6 wherein said upwardly-extending shadow-line forming means comprises a plurality of elongate strips, each of which extends upwardly over a plurality of courses of composition strips and is secured to the elongate members and composition strips that make up the courses.

12. In a method for the manufacture of a roof construction, applying composition strips in horizontal courses to an underlying inclined roof structure, with the lower edge margin of one composition strip overlapping the upper edge margin of the next lower composition strip, and then applying shadow forming elongate members horizontally over the overlapping margins of the composition strips.

13. In a method as claimed in claim 12 in which the shadow line forming members are applied to extend over the lower edge of the uppermost overlapping margin of the composition strips.

14. In a method as claimed in claim 12 in which additional shadow line forming means are applied between said horizontally applied shadow line forming members and are disposed to extend upwardly along the slope of the structure.

15. In a method as claimed in claim 14 in which said additional shadow line forming members are provided by strips that are applied to the upper surface of the composition strips at horizontally spaced intervals, said horizontal shadow line forming members being of triangular configuration and being applied upon the overlapping portions of the composition strips and over portions of said upwardly extending strips.

* * * * *